US006009293A

United States Patent [19]

Takami

[11] Patent Number: 6,009,293

[45] Date of Patent: Dec. 28, 1999

[54] OPTICAL COMMUNICATION DEVICE COMMUNICATING INFORMATION BETWEEN REVOLVING TYPE DEVELOPING DEVICE AND IMAGE FORMING APPARATUS

[75] Inventor: Nobuo Takami, Tokyo, Japan

[73] Assignee: Ricoh Company, Ltd., Tokyo, Japan

[21] Appl. No.: 08/992,995

[22] Filed: Dec. 18, 1997

[30] Foreign Application Priority Data

| | | | |
|---|---|---|---|
| Dec. 19, 1996 | [JP] | Japan | 8-355172 |
| Sep. 29, 1997 | [JP] | Japan | 9-281490 |
| Nov. 18, 1997 | [JP] | Japan | 9-333614 |

[51] Int. Cl.[6] ..... G03G 15/01

[52] U.S. Cl. ..... 399/227; 399/29

[58] Field of Search ..... 399/29, 30, 227, 399/253

[56] References Cited

U.S. PATENT DOCUMENTS

| | | | |
|---|---|---|---|
| 4,620,783 | 11/1986 | Tanaka et al. | 399/227 X |
| 4,622,916 | 11/1986 | Tanaka et al. | 399/227 X |
| 4,646,679 | 3/1987 | Ohno et al. | 399/227 X |
| 4,697,915 | 10/1987 | Hayashi et al | 399/227 |
| 5,384,628 | 1/1995 | Takami et al. | 399/255 |
| 5,587,783 | 12/1996 | Nakamura et al. | 399/227 X |
| 5,617,188 | 4/1997 | Inomata | 399/30 X |
| 5,765,059 | 6/1998 | Kosuge et al. | 399/227 X |

FOREIGN PATENT DOCUMENTS

| | | |
|---|---|---|
| 1300270 | 12/1989 | Japan . |
| 4349481 | 12/1992 | Japan . |
| 6267627 | 9/1994 | Japan . |
| 8-69144 | 3/1996 | Japan . |

*Primary Examiner*—Fred L. Braun
*Attorney, Agent, or Firm*—Cooper & Dunham LLP

[57] ABSTRACT

An image forming apparatus having a revolving type developing device including a plurality of monochrome developing members for developing a latent image formed on an image carrier with monochrome developer and a plurality of toner storing members for separately storing different toners. The apparatus includes a plurality of toner supplying members disposed in the revolving type developing device for supplying toner from one of the toner storing members to a corresponding one of the plurality of monochrome developing members. A plurality of density sensors are separately disposed in each of the monochrome developing members for sensing density of monochrome developer and generating a signal indicative of density of the monochrome developer. A light beam generating member is disposed inside the revolving type developing device for generating and irradiating a light beam with a density signal obtained by one of the density sensors. A light beam receiving member receives the light beam from the light beam generating member and is disposed at a portion of a body of the image forming apparatus in which the light beam receiving member faces the light beam generating member. A controller controls one of the toner supplying members to supply toner to a corresponding monochrome developing member facing the image carrier to keep a density of the monochrome developer stored in the monochrome developing member within a predetermined range based upon the signal received by the light beam receiving member.

21 Claims, 6 Drawing Sheets

FIG. IA
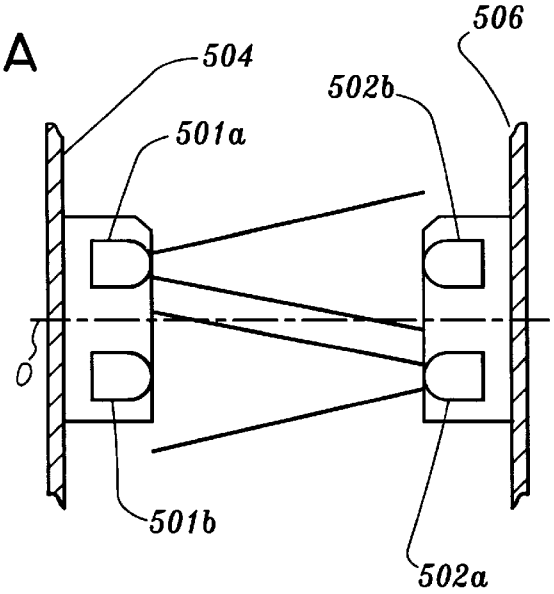
FIG. IB
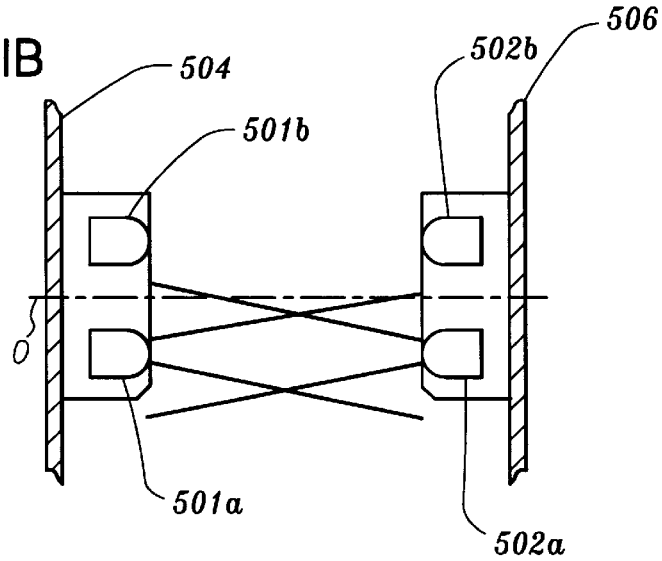
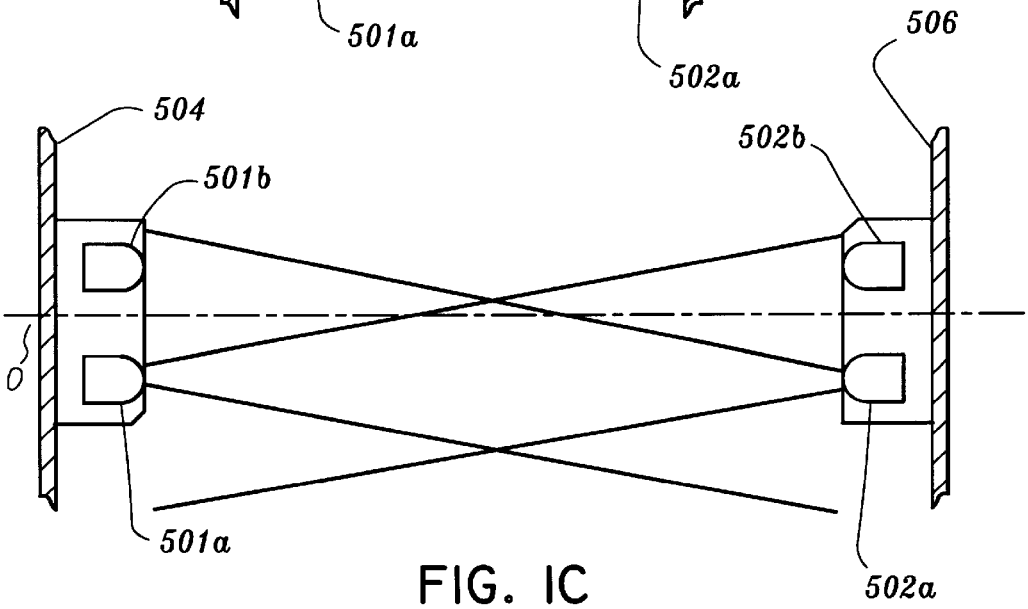
FIG. IC

OPTICAL COMMUNICATION DEVICE COMMUNICATING INFORMATION BETWEEN REVOLVING TYPE DEVELOPING DEVICE AND IMAGE FORMING APPARATUS

BACKGROUND OF THE INVENTION

1. Field of the Invention

The present invention generally relates to a full-color image forming apparatus, for example, a full-color copier, a full-color facsimile and a full-color printer, capable of making a full-color developer image by using a revolving type developing device for developing latent images with a plurality of monochrome developers. More particularly, the present invention relates to an optical communicating device for optically communicating a signal between the revolving type developing device and a body of an image forming apparatus.

2. Description of the Related Art

In a full-color image forming apparatus, a revolving type developing device is generally used.

Such a revolving type developing device generally includes four monochrome developing rooms for developing a latent image with monochrome developers, for example, yellow developer, magenta developer, cyan developer and black developer. The developing rooms are disposed around an axis of the revolving type developing device and each room separately stores one of the monochrome developers therein. A latent image is repeatedly formed on an image carrier to be separately developed by each of the plurality of monochrome developers and then separately developed by a corresponding one of the monochrome developers in a predetermined order and finally superimposed on a copy sheet, thereby obtaining a full-color developer image.

In such a conventional developing device, since a density of each of the monochrome developers has to be kept within a predetermined range to obtain a full-color copy of good quality, a density sensor is generally provided in the developing rooms and is generally utilized to sense density. Such a density sensor generates a signal indicative of density and the signal is sent to a controller for controlling a developer supplying device for supplying new monochrome developer to a corresponding developing room to keep a density of the developer within a predetermined range.

Thus, the density signal is generally sent from the revolving type developing device to a controller disposed in a body of the image forming apparatus. As shown in Japanese Laid Open Patent Application Number 08-69144, to send a density signal from a revolving type developing device to a body of an image forming apparatus, a plurality of optical beam generating members are provided on a side plate of a revolving type developing drum. Each member communicates density information from a sensor provided in a corresponding developer storing room of the drum to the body of the image forming apparatus. Each member irradiates a light beam indicating a density sensed by the corresponding density sensor disposed in the corresponding developer storing room. The plurality of optical beam generating members are generally disposed on a circumference circle on a side plate and around an axis of rotation of the revolving type developing device with a predetermined interval therebetween (e.g., at 90° intervals).

To receive light beams generated by the optical beam generating members, a photoreceptor is disposed at a portion of a body of the image forming apparatus which faces one of the optical beam generating members, when the revolving type developing device is rotated to a predetermined position. The photoreceptor is capable of receiving a light beam irradiated from one of the optical beam generating members, each time the revolving type developing device rotates through an angle of 90°.

A density signal received by the photoreceptor is input to a controller for controlling a monochrome developer supplying device for supplying new monochrome developer into a corresponding developing room to maintain the density of the monochrome developer stored therein within a predetermined range. In this way, the density signal is optically communicated from the revolving type developing device to the body of the image forming apparatus.

However, such a conventional optical sensing device is excessively costly, since it requires the use of a plurality of optical beam generating members, a complex control system for controlling the sensors to start sensing density and difficulties in providing a precise arrangement of the optical beam generating members on the side plate of the revolving type developing device.

As shown in Japanese Laid Open Patent Application Number 08-267627, an optical signal is communicated from a revolving type developing device to a body of an image forming apparatus. In this device, a light emitting diode (LED) for generating a light beam having density information relating to one of the monochrome developers is disposed in an opening of a shaft which extends from a side of the device and on the axis of rotation of the revolving type developing device.

To receive such a light beam, a photo-transistor is disposed at a portion of a body of the image forming apparatus so that the photo-transistor faces the LED. Density information is thus optically communicated from the LED to the image forming apparatus, when the LED irradiates a light beam. However, such an arrangement does not allow for mutual communication of optical information between the revolving type developing device and the body of the apparatus. In addition, the shaft in this unit extends a distance from the end of the revolving type developing device, thus making the size of the unit relatively large.

The above described apparatuses are not particularly suited for use with an optical communicating system for mutually communicating information between the image forming apparatus and the revolving type developing device. As shown in FIG. 1, an optical communicating system for mutually communicating optical information includes a first unit plate mounting a light beam generating member 501*a* for generating a light beam and a photoreceptor 501*b* for receiving a light beam. A second unit plate mounts a light beam generating member 502*a* for generating a light beam toward the photoreceptor 501*b* of the first unit plate and a photoreceptor 502*b* for receiving a light beam irradiated from the light beam generating member 501*a* of the first unit plate.

The reason that such an optical communicating system cannot be readily used in the above-described apparatuses is that the optical communicating system cannot be disposed on a side plate 504 on a center line extending from the axis of the revolving type developing device. For example, as shown in FIG. 1*b*, if the first unit plate mounting the light beam generating member 501*a* and the photoreceptor 501*b* is disposed on the side plate 504 on the center line of the axis of the revolving type developing device, optical communication can only be performed when the unit plates are aligned at predetermined positions. That is, although the light beam generating member 501*a* inherently has a predetermined diffusion angle, the light beam generated thereby is not capable of covering a corresponding photoreceptor 502*b* mounted on the second unit plate which is attached to the body 506 of the apparatus when the revolving type developing device rotates, until the first unit plate has rotated to the position as shown in FIG. 1*a*.

Further, as shown in FIG. 1*c*, if both units are disposed sufficiently far from each other to enable the light beams generated by the light beam generating members to cover the corresponding photoreceptors, an image forming device necessarily becomes too large.

SUMMARY OF THE INVENTION

The present invention relates to an image forming apparatus having a revolving type developing device including a plurality of monochrome developing members for developing a latent image formed on an image carrier with monochrome developer and a plurality of monochrome toner storing members for separately storing different monochrome toners. The apparatus comprises a plurality of monochrome toner supplying members disposed in the revolving type developing device for supplying monochrome toner from one of the monochrome toner storing members to a corresponding one of the plurality of monochrome developing members. A plurality of density sensors are separately disposed in each of the monochrome developing members for sensing density of monochrome developer and generating a signal indicative of density of the monochrome developer. A light beam generating member is disposed inside the revolving type developing device for generating and irradiating a light beam with a density signal obtained by one of the density sensors. A light beam receiving member receives the light beam from the light beam generating member and is disposed at a portion of a body of the image forming apparatus in which the light beam receiving member faces the light beam generating member. A controller controls one of the monochrome toner supplying members to supply monochrome toner to a corresponding monochrome developing member facing the image carrier to keep a density of the monochrome developer stored in the monochrome developing member within a predetermined range based upon the signal received by the light beam receiving member.

BRIEF DESCRIPTION OF THE DRAWINGS

FIG. 1*a* shows a positional relation between optical communicating devices when first and second optical communicating devices face each other at an initial position of a revolving type developing device;

FIG. 1*b* shows a positional relation between the first and second optical communicating devices when the revolving type developing device rotates by an angle of 180°;

FIG. 1*c* shows a positional relation between the first and second optical communicating devices when the optical communicating devices are disposed relatively far from each other;

DETAILED DESCRIPTION

An embodiment of the present invention is explained hereinbelow referring to FIGS. 2 to 6.

Figure 2:
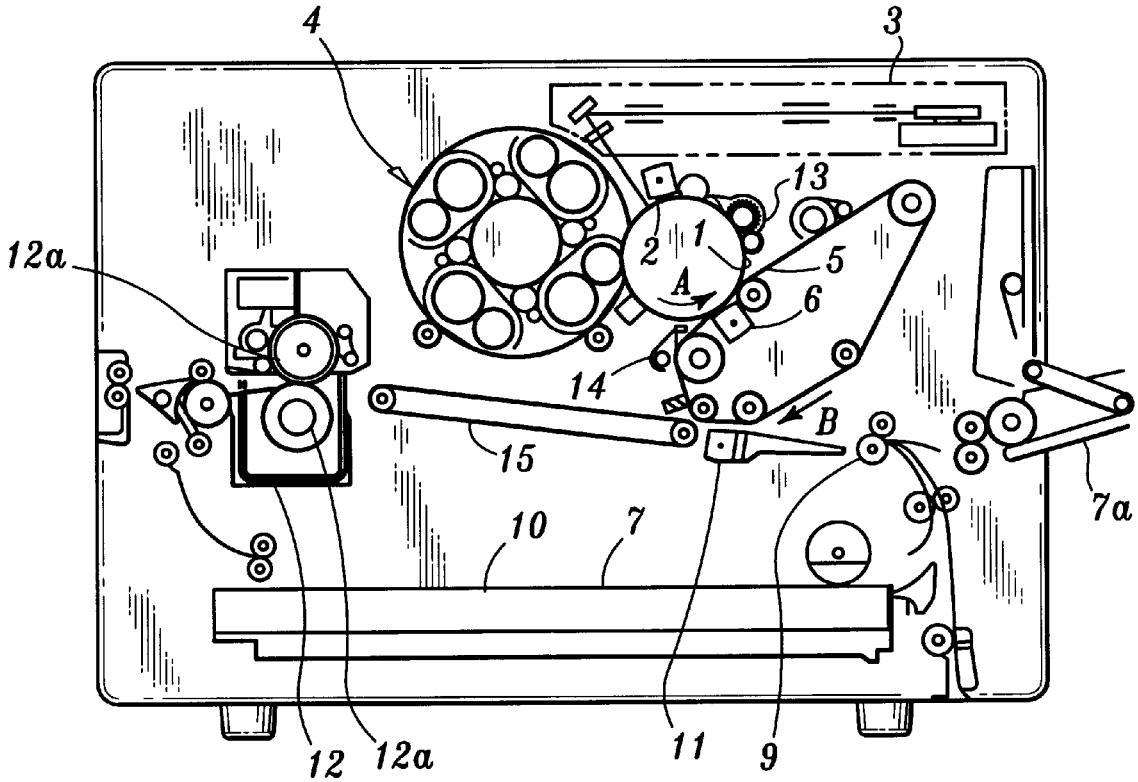
FIG. 2 is a schematic cross-sectional view of an image forming apparatus employing the revolving type developing device according to an embodiment of the present invention.

A color printer as an example of a color image forming apparatus is illustrated in FIG. 2. As shown in FIG. 2, the color printer includes a photo-conductive drum 1 (hereinafter referred to as PC drum 1) for carrying a latent image thereon. The PC drum 1 is uniformly discharged by a discharge device 2 and exposed by a laser beam generating device 3 using image information which is stored in a memory (not shown) thereby forming a latent image on a periphery of the PC drum 1 during rotation of the PC drum 1. A plurality of monochrome image information for a yellow image, a magenta image, a cyan image and/or a black image are separately resolved from full-color image information and stored in the memory. A latent image for forming a yellow image, a magenta image, a cyan image and/or a black image is repeatedly formed on the PC drum 1 during each rotation thereof. Each latent image is separately developed by a yellow developer, a magenta developer, a cyan developer and/or a black developer. Each developer is separately stored in a separate developing room of the revolving type developing device 4. Color toner images are formed on the PC drum 1 during a plurality of rotations thereof, (e.g., three or four rotations thereof).

Each monochrome developer consists of a two component developer. Two component developers are composed of carrier beads and a monochrome toner.

Each of the images is separately developed by a different monochrome developer during a different rotation of the PC drum 1 and each resulting toner image is separately transferred by use of a first transfer discharge unit 6 onto a predetermined portion of a medium transfer belt 5 which rotates in synchronization with the PC drum 1 in a predetermined direction as shown by arrow B illustrated in FIG. 2. Accordingly, a full-color toner image is formed on the predetermined portion of the medium transfer belt 5.

The full-color toner images are transferred by transfer discharge unit 11 at one time onto a copysheet 10 which is fed via registration roller 9 from either a manual feed tray 7*a* or a sheet cassette 7. The copysheet 10 carrying the full-color toner image thereon is transferred by a transfer belt 15 provided below the revolving type developing device 4 toward a fixing device 12 which includes fixing rollers 12*a* for fixing the full-color toner image onto the copysheet 10. The copysheet 10 having the full-color toner image fixed thereon is then fed by the fixing device 12 to an outside of the printer body.

Toner which has not been transferred onto the medium transferring belt 5 and which remains on a periphery of the PC drum 1 is wiped from the PC drum 1 with a PC drum cleaner 13. Also, toner which has not been transferred onto the copysheet 10 and which remains on the medium transfer belt 5 is wiped from the medium transfer belt 5 with a medium transfer belt cleaner 14.

Figure 5:
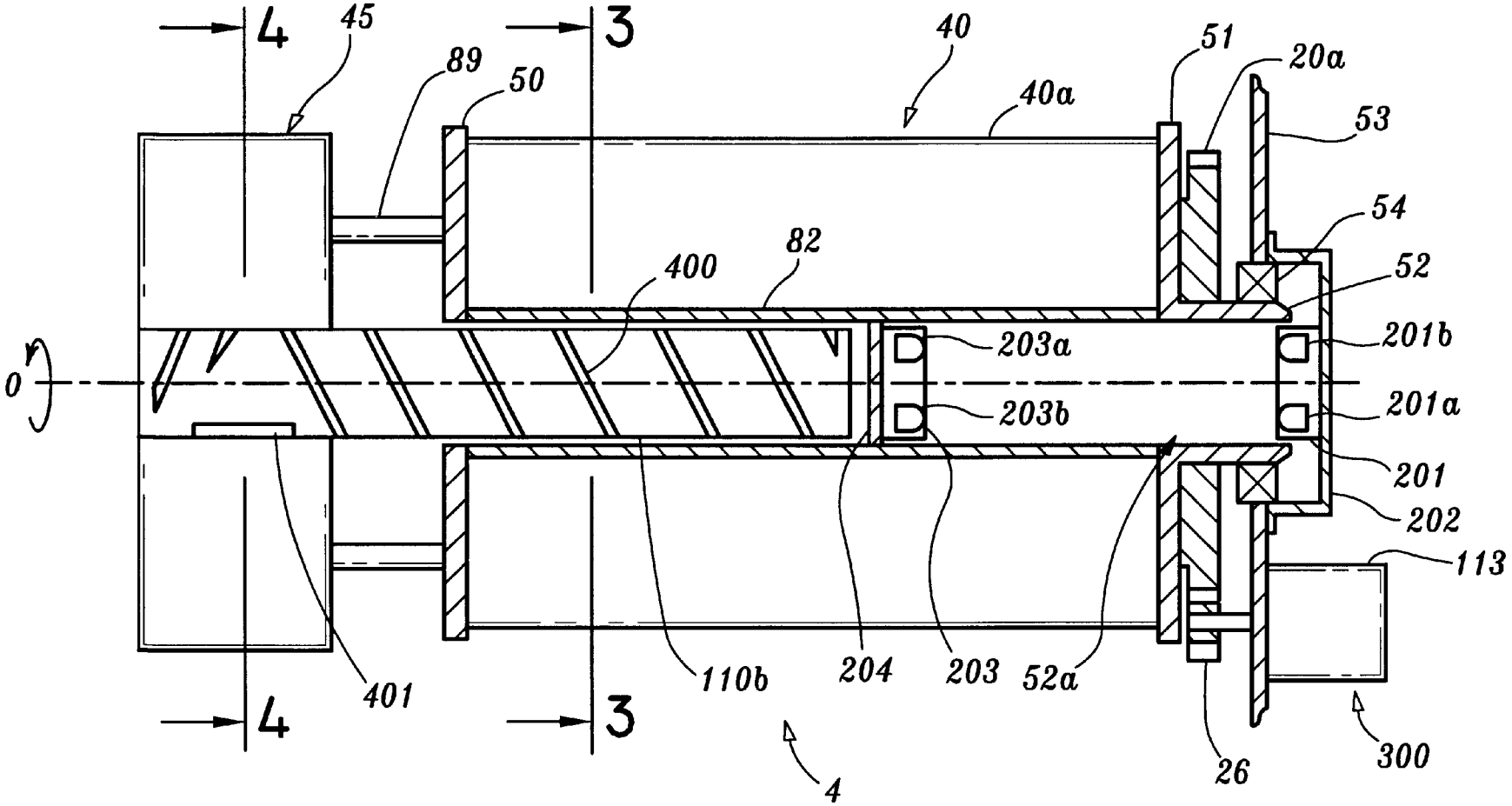
FIG. 5 is a schematic cross-sectional view of a revolving type developing device of an image forming apparatus according to an embodiment of the present invention.

Hereinafter, a structure of a revolving type developing device 4 is explained in more detail. In FIG. 5, for discussion purposes, the left side of the figure is referred to as a front side of the printer whereas the right side of the figure is referred to as a back side thereof. Referring briefly to FIG. 5, the revolving type developing device 4 generally includes a developing unit 40 capable of freely rotating around a central axis thereof and a toner storing unit 45 capable of coaxially rotating with the developing unit in a body (not shown) around the central axis. The developing unit 40 includes therein a plurality of developing rooms for separately storing yellow developer, magenta developer, cyan developer and black developer used for separately developing a plurality of latent images separately formed on the PC drum 1. The toner storing unit 45 includes a plurality of toner storing cases for separately storing therein new yellow toner, new magenta toner, new cyan toner and new black toner. Each new toner is separately supplied into a corresponding one of the developing rooms of the developing unit 40 storing the corresponding monochrome developer. The developing unit 40 includes a hollow shaft 82 in which a portion of a black monochrome toner storing case 110B having partially cylindrical shape and storing a black toner to be supplied to a corresponding developing room is inserted.

Figure 3:
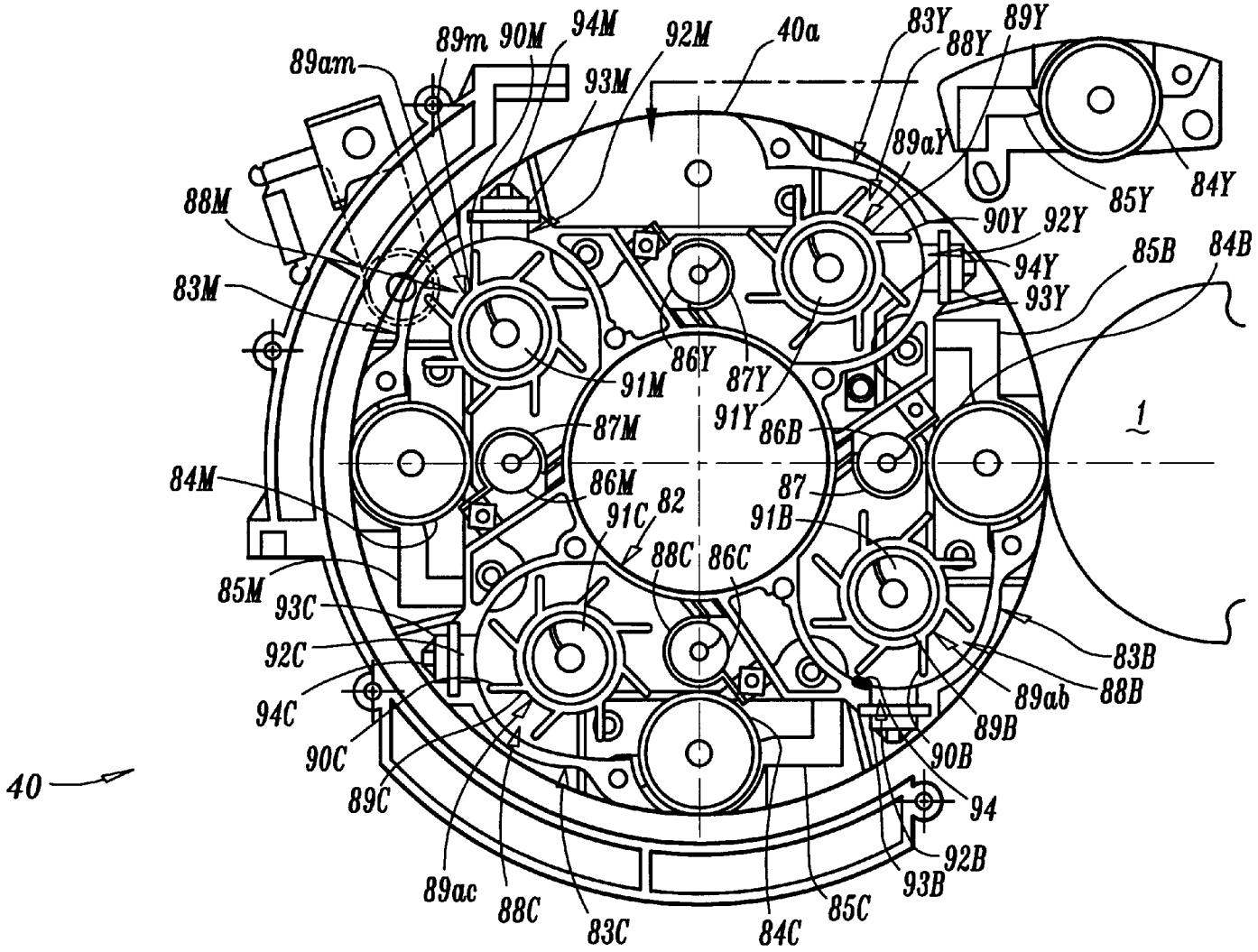
FIG. 3 is a side cross-sectional view taken along lines 3—3 of FIG. 5 of the developing unit showing a plurality of developing rooms.

Referring now to FIG. 3 which shows a cross-section of developing unit 40, a plurality of developing rooms are formed by equally dividing a space between the hollow shaft 82 and an outer case 40*a* into four partitioned areas. The partitioned areas form developing rooms 83Y, 83M, 83C and 83B, each for storing and developing with yellow developer, magenta developer, cyan developer and black developer, respectively. Each of the developing rooms is disposed around an outer periphery of the hollow shaft 82 in a predetermined order as shown.

As shown in FIG. 3, the developing unit 40 is rotated so that black developing room 83B is positioned at a developing station adjacent PC drum 1. A latent image formed on the PC drum 1 can then be developed with the black monochrome developer stored in developing room 83B which is adjacent to the PC drum 1. The apparatus is thus capable of developing the latent image with black monochrome developer. During developing with the black monochrome developer, the other monochrome developing rooms 83Y, 83M and 83C are disposed outside of the developing station at predetermined positions.

Since a structure of each of the four developing rooms is similar, only the elements associated with the black developing room 83B will be explained in detail. However, it should be understood that the same number refers to like elements in each of the developing rooms, with an initial of Y, M, C and B following the number identifying which developing room is specifically being referred to.

As shown in FIG. 3, an opening which faces PC drum 1 is formed in black developing room 83B. A developing roller 84B for developing a latent image formed on the PC drum 1 with black toner is disposed in a manner that a portion of an outer periphery of developing roller 84B protrudes from the opening toward the PC drum 1. PC drum 1 rotates in a counter clockwise direction and developing roller 84B rotates in a clockwise direction. A doctor blade 85B is disposed in the black developing room 83B to evenly form to a predetermined thickness the black monochrome toner carried on a periphery of the developing roller 84B. An elongate upper screw 86B extends in a direction parallel to the axis of the developing roller 84B in the black developing room 83B for gathering black toner which has been scraped off of the developing roller 84B by the doctor blade 85B and transferring it from a back side of the black developing room 83B to a front side thereof. Upper screw 86B then ejects the transferred toner downward to a lower screw 91B as will be explained later below in more detail. A guide 87 is disposed beside the screw 86B to lead the toner scraped off by the doctor blade 85B to the screw 86B. A paddle member 88B is disposed in the black developing room 83B for paddling developer stored in the black developing room 83B. The paddle member 88B includes an elongate hollow cylindrical member 89B which extends in a direction parallel to an axis of the PC drum 1. Paddle member 88B further includes a plurality of ejecting openings 89*ab* intermittently formed in the hollow cylindrical member 89B. Ejecting openings 89*ab* extend the width of the hollow cylindrical member 89B for ejecting toner from hollow cylindrical member 89B to black developing room 83B. Paddle member 88B includes paddling plates 90B radially protruding from the hollow cylindrical member 89B for paddling the developer.

Lower screw 91B is disposed in the hollow cylindrical member 89B to transfer both toner scraped by the doctor blade 85B and ejected from the upper screw 86B and new toner supplied from a toner storing case in toner storing unit 45. The toner is transferred by lower screw 91B from a front side of the developing room 83B to a back side thereof through the hollow cylindrical member 89B. The toner is finally ejected from the plurality of ejecting openings 89*ab* into the black developing room 83B when the paddle member 88B is rotated. Thereby, when developing, the black developer stored in the black developing room 83B is circulated by the upper screw 86B and the lower screw 91B. When a density of the black developer, sensed by a sensor 94, becomes thinner than a predetermined range, new monochrome toner can be supplied from a black toner storing case in toner storing unit 45, explained later in detail, and transferred by the lower screw 91B into the black developing room 83B.

In addition, a slot 92B is formed at a bottom of the black developing room 83B for allowing fresh monochrome developer having a predetermined ratio of carrier beads and developer to be added to the developing room. This allows fresh monochrome developer to be manually added to the black developer stored in the black developing room 83B through the slot 92B when black developer stored in the developing room 83*b* has deteriorated.

A cap 93B is used to selectively seal or open slot 92B when adding fresh black monochrome developer. When developer which has deteriorated is to be removed and exchanged with fresh developer through the slot 92B, it is preferable to remove the revolving type developing device 4 from a printer body and manually rotate the developing roller 84B, both the upper and lower screws 86B and 91B and the paddle member 88B utilizing a jig to eject the deteriorated developer from the developing room 83B. When fresh monochrome black developer is to be supplied into the developing room 83B through the slot 92B, it is preferable to manually rotate the developing roller 84B, both the upper and lower screws 86B and 91B and the paddle member 88B utilizing a jig to smoothly introduce and evenly disperse the fresh monochrome black developer as fresh developer is added via slot 92B to the developing room 83B.

Figure 4:
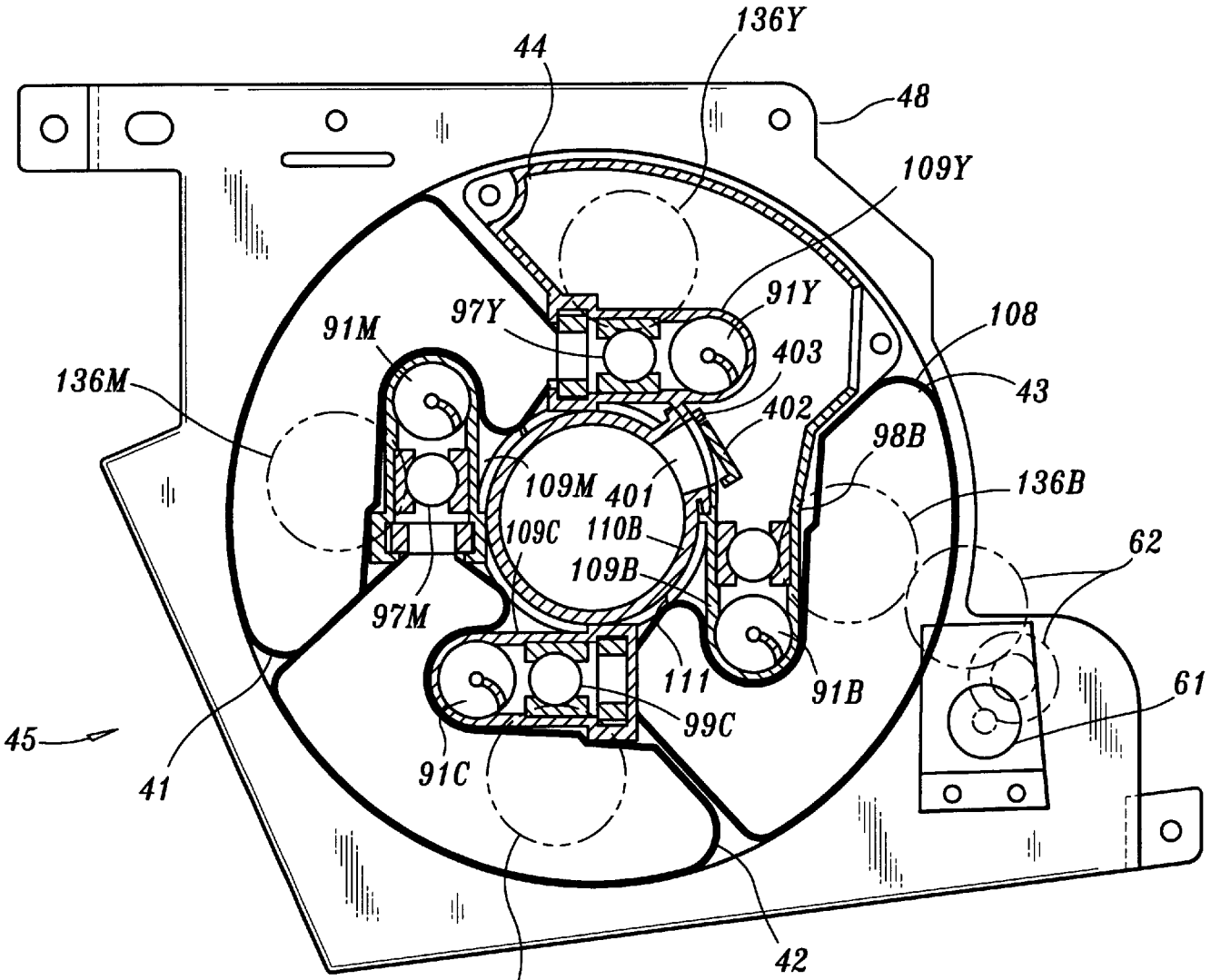
FIG. 4 is a schematic side cross-sectional view taken along lines 4—4 of FIG. 5 of a toner storing unit for storing a plurality of new and different monochrome toners to be fed into the corresponding one of developing rooms shown in FIG. 3.

As shown in FIG. 4, the toner storing unit 45 includes four developer transfer cases 109Y, 109M, 109C and 109B for separately transferring yellow toner, magenta toner, cyan toner and a black toner from the individual toner storing cases 41, 42, 43 and 44, respectively, to developing unit 40. Each of the toner transfer cases is separately connected to a corresponding one of the developing rooms 83Y, 83M, 83C and 83B via a corresponding one of lower screws 91Y, 91M, 91C and 91B extending from the toner unit 40 to the toner storing unit 45.

The toner storing unit 45 includes a unit plate 108 having a disk shape on which each of the toner storing cases 41, 42, 43 and 44 and toner supplying rollers 97Y, 97M, 97C and 97B, which are separately disposed in each of corresponding toner transfer cases 109Y, 109M, 109C and 109B, are mounted. The toner supplying rollers supply toner from toner storing cases 41, 42, 43 and 44 to transfer cases 109Y, 109M, 109C and 109B, respectively.

Since black monochrome toner is usually most frequently used by an operator, the black toner storing case 44 has more storage space than the other storing cases 41–43. For example, the black toner storing case 44 includes a cylindrical tube 110B which extends through a center opening 111 of unit plate 108 and into hollow shaft portion 82 of the developing unit 40. Toner is conveyed from tube 110B to storing case 44 through slot 401 provided between storing case 44 and tube 110B. Referring again to FIG. 5, the toner in tube 110B is transferred in the direction of toner storing unit 45 by screw-like projections 400 extending from an inside surface of tube 110B, during rotation of the developing device. A door 402, pivotally attached at point 403, opens and closes by gravity during rotation of toner storing unit 45. This allows toner to be moved by gravity from tube 110B to storing case 44 and prevents reverse flow of the developer.

Each of the shafts of the toner supplying rollers 97Y 97M, 97C and 97B are supported by the unit plate 108 via bearing members (not shown). When the revolving type developing device 4 rotates by a predetermined angle, a black developing room 83B, for example, comes to a developing station adjacent PC drum 1. At this time, the toner supplying roller 97B disposed in the black toner transfer case 109B, which rotates with the corresponding developing room 83B, comes to a position just above an end portion of the lower screw 91B disposed in paddle member 88B. Lower screw 91B extends from black developing room 83B of the developing unit 40 to black toner transfer case 109B of the toner storing unit 45.

The toner supplying roller 97B rotates and a black toner is supplied from the black toner storing case 44 into transfer case 109B and into the end portion of the lower screw 91B under influence of gravity. The toner is then transferred to the black developing room 83B disposed in the developing unit 40 by the lower screw 91B. The upper and lower screws 86 and 91 are driven by motors (not shown) controlled by a controller described later.

A plurality of openings, not shown, are formed on the unit plate 108 at predetermined intervals on a circumference circle for separately allowing insertion of portions of each of the lower screws 91Y, 91M, 91C and 91B extending from the corresponding one of monochrome developing rooms 83Y, 83M, 83C and 83B of the developing unit 40 to each one of the corresponding toner transfer cases 109Y, 109M, 109C and 109B disposed in the toner storing unit 45. Thereby, each of the monochrome toners stored in the toner storing cases can be transferred by each of the transfer screws 91Y, 91M, 91C and 91B to each of the corresponding developing rooms. A shaft of each of the toner supplying rollers 97Y, 97M, 97C and 97B is also separately supported by the unit plate 108 such that one end of each shaft protrudes through the unit plate 108. Each protruding shaft end has an end gear (not shown) mounted thereon.

Further, meshing gears 136Y, 136M, 136C and 136B for meshing with the corresponding end gears mounted on the ends of each of the shafts of the toner supplying rollers 97Y, 97M, 97C and 97*b* are mounted on a back side of the unit plate 108 on the same side as the end gears. More specifically, the meshing gears and end gears are provided at a back side of the unit plate 108, namely, on a back side of the printer.

A pair of medium gears 62 is mounted on a front plate 48 which is secured to a body of the printer. Front plate 82 has a hole for receiving and supporting and allowing toner storing unit 45 to rotate. One of the medium gears 62 meshes with one of meshing gears 136Y, 136M, 136C and 136B of the toner supplying rollers when a corresponding developing room is at the developing station adjacent PC drum 1. A driving gear 61 is mounted on a shaft of a driving motor (not shown), mounted on the body of the printer and meshes with one of the medium gears 62, thereby rotating the corresponding one of the toner supplying rollers 97Y, 97M, 97C and 97B via the corresponding meshing gear 136 when the motor is activated by a controller. The toner supplying roller is thus rotated to supply one of the monochrome toners into a transfer case 109 and then to a corresponding one of the developing rooms 83Y, 83M, 83C and 83B via one of lower screws 91Y, 91M, 91C and 91B disposed in one of paddle members 88Y, 88M, 88C and 88B.

Figure 6:
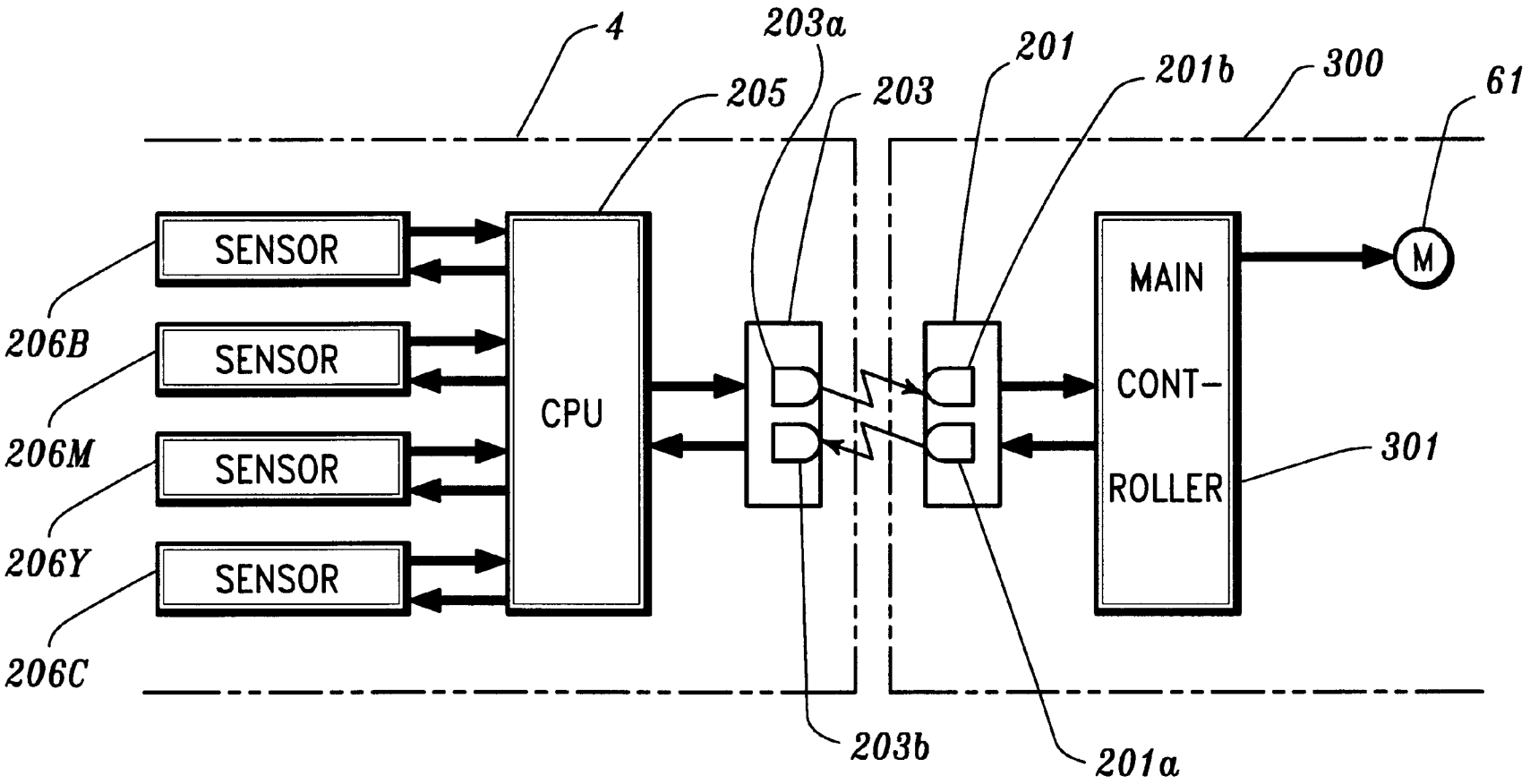
FIG. 6 is a block diagram of a controller of an image forming apparatus according to an embodiment of the present invention showing optical communication between the revolving type developing device and an image forming apparatus.

Hereinafter, an optical communicating system employed for mutually communicating between revolving type developing device 4 and a printer body 300 is explained in detail referring to FIGS. 5 and 6.

A developing unit 40 includes both side plates 50 and 51, a hollow shaft portion 82 formed by dividing an inside of a hollow shaft 52 by a partition wall 204, and an outer casing 40*a* for enclosing the plurality of developing rooms which are disposed around hollow shaft 82 of the developing unit 40 between the plates 50 and 51. The developing unit 40 is disposed at a relative back side of a printer body 300 and the toner storing unit 45 is disposed near a relative front side of the printer body 300 for easy maintenance thereof.

An elongate black toner storing case tube 110B extends into a middle portion of the hollow shaft portion 82 so that the apparatus can store substantially much more black toner than other monochrome toners as described above. The hollow shaft 52 of the revolving type developing device 4 is supported by a body plate 53, disposed in printer body 300, via a bearing member 54 mounted on the body plate 53 so that an axis of the revolving type developing device 4 is disposed on a same plane as a shaft of the PC drum 1. The axis of the revolving type developing device 4 is disposed in a direction in parallel with the axis of the PC drum 1. Body plate 53 is disposed at a backside of printer body 300.

A revolver gear 20*a* is integrally mounted on the hollow shaft 52 at a position near a back side end portion of the hollow shaft 52 of the revolving type developing device 4. A revolver driving gear 26 is mounted on an axis of a motor 113 for rotating the revolver driving gear 26. Driving gear 26 meshes with the revolver gear 20*a*, thereby rotating the developing unit 40 when the motor 113 rotates. The motor 113 is controlled to rotate developing device 4 step wise by an angle of 90° at a time after each monochrome developing process has been completed so that a next one of the developing rooms is positioned at the developing station.

A sensor bracket 202 is mounted on a portion of the body plate 53 which faces hollow shaft 52 of developing unit 40. A first communicating device including a light beam generating member 201*a* for irradiating a light beam and a photoreceptor 201*b* for receiving a light beam are mounted on the first optical communicating unit 201 disposed in the sensor bracket 202. As shown in FIG. 5, one side of the hollow shaft 52 is opened to allow passage of a light beam irradiated from the light beam generating element 201*a* of the first optical communicating unit 201 and a light beam to be received by the photoreceptor 201*b* of the first optical communicating unit 201. Partition wall 204 is disposed at about a middle portion of the hollow shaft 52. The second optical communicating unit 203 is mounted on a side of the partition wall 204 and includes a light beam generating element 203*a* for irradiating a light beam toward the photoreceptor 201*b* of the first optical communicating unit 201 and a photoreceptor 203*b* for receiving a light beam irradiated from light beam generating member 201*a* of the first optical communicating unit 201.

The first and second optical communicating units 201 and 203 are symmetrically disposed about an axis of the developing unit 40. Thereby, the light beam generating member 203*a* of the second optical unit 203 faces the photoreceptor 201*b* of the first optical communicating member 201, and the light beam generating member 201*a* of the first optical communicating unit 201 faces the photoreceptor 203*b* of the second optical communicating unit 203 at a predetermined rotational angle, for example, an angle of zero, of the revolving type developing device 4.

As described above, a plurality of density sensors are separately disposed in each of the developing rooms to detect density of each of the monochrome developers and each generates a signal indicative of density. A signal produced by each of the density sensors is converted into an optical light beam signal by a converter (not shown), and the optical light beam signal is irradiated by light beam generating member 203*a* (e.g., an LED), to the photoreceptor 201B disposed opposite thereto. Accordingly, a signal indicative of density of each of the monochrome developers which is generated by each of the density sensors can be optically communicated from the developing unit 40 via the second optical communicating unit 203 to the body of the printer via the first optical communicating unit 201. The signal received by the first optical communicating device 201 is sent to a controller 301 (FIG. 6) of the printer. In addition, control information can be optically communicated from the body of the printer via the first optical communicating unit 201 to the developing unit 40 via the second optical communicating unit 203.

The controller 301 selectively controls one of toner supplying rollers 97Y, 97M, 97C and 97B and one of lower screws 91Y, 91M, 91C and 91B to supply the corresponding new monochrome toner from a toner storing case to a corresponding developing room positioned at the developing station facing the PC drum 1 to keep a density of the developer within a predetermined range.

Even if a positional relation between the second optical communicating unit 203 and the first optical communicating unit 201 changes when the developing unit 40 and, accordingly, the second optical communicating unit 203 are rotated by an angle, the developer control and sensing signals can still be communicated correctly. For example, since the second optical communicating unit 203 is disposed at about a middle portion of the hollow shaft 52 and is disposed sufficiently far from the first optical communicating unit 201, the light beam irradiated from each of the light beam generating members 201*a* and 203*a* (which inherently have a diffusion angle) will reach each of the corresponding photoreceptors 201*b* and 203*b*. Accordingly, the optical signals can be mutually communicated between the second optical communicating unit 203 and the first optical communicating unit 201. In other words, according to the embodiment of the present invention, the second optical communicating unit 203 is disposed at a position in the hollow shaft where the irradiated light beam which diffuses by a predetermined angle is always able to reach the corresponding photoreceptor.

Further, since the second optical communicating unit 203 is disposed on a revolution center line ⊖ of the developing unit 40, and the light beam generating member 203*a* and the photoreceptor 203*b* are disposed close to each other and symmetrically about the revolution center line ⊖, both the light beam generating element 203*a* and the photoreceptor 203*b* are always the same distance from the revolution center line ⊖ during rotation of the developing unit 40. Thus, the light beam generated by the light beam generating element 203*a* of the second optical communicating unit 203 sufficiently covers the photoreceptor 201*b* of the first communicating unit 201 during revolution of the revolving type developing device 4. The same is true about photoreceptor 203*b* and light beam generating member 201*a*.

In the above described embodiment, a light beam generating member generating a light beam having a relatively small light diffusing angle can be utilized as an optical communicating member, since the light beam generating member easily covers the corresponding photoreceptor due to the positioning of both the light beam generating members and the photoreceptors which are separately closely disposed about the rotational center of the hollow shaft 52.

Further, a light beam generating member generating a light beam having a relatively large diffusion angle can alternatively be used. Preferably, in this case, a light beam shielding plate for partially shielding the diffused light beam is used.

In such embodiments, the light beam irradiated from light beam generating member 203*a* of the second optical communicating unit 203 will not be received by photoreceptor 203*b*, since a diffusion angle of the light beam generated by the light beam generating member is relatively small and never reaches photoreceptor 203*b*. The same is true of the light beam generating member 201*a* and the photoreceptor 201*b* of the first optical communicating unit 201. Further, optical communication of signals between the first and second optical communicating units can mutually and simultaneously be performed by avoiding light beam interference, which occurs when a light beam having too large a diffusion angle is used. Further, if an inner surface of the hollow shaft between the first and second optical communicating units 201 and 203 is painted a color having a low light reflectively, for example black or brown, or is roughened to diminish light reflection, such light beam interference can even more readily be avoided.

Hereinafter, a density control for the revolving type developing device using an optical communicating device is explained in detail referring to FIG. 6.

When sensing density, a main controller 301 selects one of developer density sensors 206B, 206M, 206Y, and 206C separately disposed in the corresponding one of developing rooms 83B, 83Y, 83M and 83C which is currently positioned at a developing station facing PC drum 1. Main controller 301 then sends a control signal to the developer density sensor disposed in the developing room facing PC drum 1 to start sensing density of the monochrome developer. This signal is sent by irradiating a light beam having a control signal from light beam generating member 201*a* of the first optical communicating unit 201 to photoreceptor 203*b* of the second optical communicating unit 203. The control signal received by the photoreceptor 203*b* of the second optical communicating device 203 is sent to a CPU 205 disposed in the revolving type developing device 4 and the CPU 205 controls a density sensor disposed in the developing room positioned at the developing station to start sensing density of monochrome developer stored in the developing room.

When the density sensor has sensed the density of the monochrome developer, a voltage corresponding to the sensed density is input to the CPU 205. After the voltage is converted into a digital signal by the CPU 205, the CPU 205 sends the digital signal to the first optical communicating unit 201. This signal is sent by irradiating a light beam having the digital signal via light beam generating member 203*a* of the second optical communicating unit 203 in a form of serial information. The serial signal received by the photoreceptor 201*b* of the first optical communicating unit 201 is sent to the main controller 301 disposed in printer body 300.

The main controller 301 compares the signal received by the second optical communicating device 201 with a predetermined reference signal corresponding to a predetermined density of a monochrome developer and generates a command signal and sends a command signal to a developer supplying motor which rotates the proper motors and gears including driving gear 61 to rotate the toner supplying roller 97 for supplying a monochrome toner. The same control is applied to the other monochrome developing units when each monochrome developing process is executed. Thereby, supplying of each of the monochrome toners is automatically performed to keep the monochrome developers within a predetermined density range.

A developing bias applying memeber (not shown), discharge device 2 and a transfer bias applying member (not shown), can be controlled by the CPU disposed in the developing unit based upon a density signal generated by a density sensor to obtain a copy of good quality instead of controlling the toner supplying member.

Although the present invention has been described with respect to the use of density sensors, other types of sensors can be used in addition to or in place of the density sensors. For example, sensors can be used to detect a remaining amount of toner and/or to detect color.

Of course, numerous additional modifications and variations of the present invention are possible in light of the above teachings. It is therefore to be understood that within the scope of the appended claims, the present invention may be practiced otherwise than as specifically described herein.

What is claimed is:

1. An image forming apparatus having a revolving type developing device including a plurality of monochrome developing members for developing a latent image formed on an image carrier with monochrome developer and a plurality of monochrome toner storing members for separately storing different monochrome toners, said apparatus comprising:

a plurality of toner supplying members disposed in said revolving type developing device for supplying toner from one of said monochrome toner storing members to a corresponding one of said plurality of monochrome developing members;

a plurality of density sensors separately disposed in each of said monochrome developing members for sensing density of monochrome developer and generating a signal indicative of density of said monochrome developer;

a light beam generating member disposed inside said revolving type developing device for generating and irradiating a light beam with a density signal obtained by one of said density sensors;

a light beam receiving member for receiving said light beam from said light beam generating member, said light beam receiving member disposed at a portion of a body of said image forming apparatus in which said light beam receiving member faces said light beam generating member; and a controller for controlling one of said toner supplying members to supply toner to a corresponding monochrome developing member facing said image carrier to keep a density of said monochrome developer stored in said monochrome developing member within a predetermined range based upon said signal received by said light beam receiving member.

2. An image forming apparatus as claimed in claim 1, wherein said light beam generating member is disposed in a portion of a hollow shaft forming an axis of said revolving type developing device.

3. An image forming apparatus as claimed in claim 2, wherein said light beam receiving member is disposed on a member of a body of said image forming apparatus which is disposed outside of the portion of the hollow shaft.

4. An image forming apparatus as claimed in claim 1, further comprising:

a hollow shaft forming a rotational axis of said revolving type developing device and which is disposed at a rotational center of said revolving type developing device; and a partition member disposed at an inside of said hollow shaft for mounting said light beam generating member.

5. An image forming apparatus as claimed in claim 1, further comprising:

a density sensor controller disposed in a body of said image forming apparatus for controlling one of said plurality of density sensors to start sensing density of monochrome developer stored in a corresponding monochrome developing member by sending a command signal to said density sensor when said monochrome developing member faces an image carrier.

6. An image forming apparatus as claimed in claim 1, wherein said light beam generating member has relatively narrow light beam diffusion.

7. An image forming apparatus having a revolving type developing device including a plurality of monochrome developing members for developing a latent image formed on an image carrier with monochrome developer and a plurality of monochrome toner storing members for separately storing different monochrome toners, said apparatus comprising:

a plurality of toner supplying members disposed in said revolving type developing device for supplying toner from one of said monochrome toner storing members to a corresponding one of said plurality of monochrome developing members;

a plurality of density sensors separately disposed in each of said monochrome developing members for sensing density of monochrome developer and generating a signal indicative of density of said monochrome developer;

a first optical communicating unit disposed at an inside of said revolving type developing device and having a light beam generating member for generating and irradiating a light beam having a density signal from said revolving type developing device and a light beam receiving member for receiving a light beam having a control signal from a body of said image forming apparatus;

a second optical communicating unit having a light beam receiving member for receiving said light beam irradiated from said light beam generating member of said first optical communicating unit and a light beam generating member for generating and irradiating a light beam having a control signal toward said light beam receiving member of said first optical communicating unit, said second optical communicating unit being disposed at a portion of a body of said image forming apparatus in which said second optical communicating unit faces said first optical communicating unit; and a controller for controlling one of said toner supplying members to supply toner to a corresponding monochrome developing member facing an image carrier to keep a density of said monochrome developer stored in said monochrome developing member within a predetermined range based upon said density signal.

8. An image forming apparatus as claimed in claim 7, further comprising:

a hollow shaft forming a rotational axis of said revolving type developing device and disposed at a rotational center of the revolving type developing device; and a partition member disposed at an inside of said hollow shaft for mounting said first optical communicating unit.

9. An image forming apparatus as claimed in claim 8, wherein said hollow shaft includes an inner surface having low light reflectivity at a front side of said partition member.

10. An image forming apparatus as claimed in claim 8, further comprising:

a cylindrical portion of a black toner storing member inserted into said hollow shaft from a back side of said partition member.

11. An image forming apparatus as claimed in claim 7, further comprising:

a density sensor controller disposed in a body of said image forming apparatus for controlling one of said plurality of density sensors to start sensing density of monochrome developer stored in a corresponding monochrome developing member by sending a command signal to said density sensor when said monochrome developing member faces an image carrier.

12. An image forming apparatus as claimed in claim 7, wherein said first and second optical communicating units are disposed on a center line extending from an axis of rotation of said revolving type developing device.

13. An image forming apparatus as claimed in claim 12, wherein the light beam generating members and the light beam receiving member of said first and second optical communicating units are symmetrically disposed on said center line.

14. An image forming apparatus as claimed in claim 7, wherein said optical beam generating members of said first and second optical communicating units have relatively narrow light beam diffusion.

15. An image forming apparatus as claimed in claim 7, further comprising:

a controller for controlling said light beam generating members separately mounted on said first and second optical communicating units to simultaneously irradiate light beams from each of said first and second optical communicating units.

16. An image forming apparatus having a revolving unit including at least one image forming device, said apparatus comprising:

at least one condition sensor disposed in said revolving unit, for sensing a condition of said at least one image forming device and generating a condition signal indicative of a condition of said at least one image forming device;

a light beam generating member disposed at an inside of said revolving unit for generating and irradiating a light beam having said condition signal obtained by said at least one condition sensor;

a light beam receiving member for receiving said light beam, said light beam receiving member disposed in a portion of a body of said image forming apparatus in which said light beam receiving member faces said light beam generating member; and a controller for controlling said at least one image forming device based upon said condition signal received by said light beam receiving member.

17. An image forming apparatus as claimed in claim 16, wherein said light beam generating member is disposed in a hollow portion of a shaft forming an axis of said revolving unit.

18. An image forming apparatus as claimed in claim 17, wherein said light beam receiving member is disposed at a portion of a body of said image forming apparatus outside of said hollow portion of said shaft.

19. An image forming apparatus having a revolving unit including at least one image forming device, said apparatus comprising:

at least one condition sensor disposed in said revolving unit for sensing a condition of said at least one image forming device and generating a condition signal indicative of a condition of said at least one image forming device;

a first optical communicating unit disposed at an inside of said revolving unit having a light beam generating device for generating and irradiating a light beam having said condition signal and a light beam receiving member for receiving a light beam having a control signal;

a second optical communicating unit having a light beam receiving member for receiving said light beam irradiated from said first optical communicating unit and a light beam generating member for generating and irradiating a light beam having a control signal for controlling said at least one image forming device, said second optical communicating unit being disposed in a portion of a body of said image forming apparatus in which said second optical communicating unit faces said first optical communicating unit; and a controller for controlling said at least one image forming device based upon said condition signal.

20. An image forming apparatus as claimed in claim 19, wherein said first optical communicating unit is disposed in a hollow portion of a shaft forming an axis of said revolving unit.

21. An image forming apparatus as claimed in claim 20, wherein said second optical communicating unit is disposed at a portion of a body of said image forming apparatus outside of said hollow portion of said shaft.

* * * * *

UNITED STATES PATENT AND TRADEMARK OFFICE

CERTIFICATE OF CORRECTION

PATENT NO. : 6,009,293
DATED : December 28, 1999
INVENTOR(S) : Nobuo Takami

It is certified that error appears in the above-identified patent and that said Letter Patent is hereby corrected as shown below:

Cover page, item [54], line 1, change "COMMUNICATION" to --COMMUNICATING--.

Signed and Sealed this

First Day of August, 2000

*Attest:*

Q. TODD DICKINSON

*Attesting Officer*

*Director of Patents and Trademarks*